United States Patent [19]

Corn et al.

[11] 4,004,600

[45] Jan. 25, 1977

[54] DISHWASHER WITH SPECIAL LOW WASHING LIQUID USAGE CYCLE

[75] Inventors: Adolph Duane Corn, Stevensville; Jack F. Clearman, St. Joseph, both of Mich.

[73] Assignee: Whirlpool Corporation, Benton Harbor, Mich.

[22] Filed: Feb. 3, 1975

[21] Appl. No.: 546,525

[52] U.S. Cl. ..... 134/57 D; 134/176; 134/193

[51] Int. Cl.[2] ..... B08B 3/02

[58] Field of Search ..... 134/56 D, 57 D, 58 D, 134/176, 186, 191, 193

[56] References Cited

UNITED STATES PATENTS

| | | | |
|---|---|---|---|
| 1,596,969 | 8/1926 | Hedstrom | 134/193 X |
| 3,084,701 | 4/1963 | Hardy et al. | 134/182 X |
| 3,160,164 | 12/1964 | Constance et al. | 134/176 |
| 3,179,307 | 4/1965 | Duncan et al. | 134/140 |
| 3,465,762 | 9/1969 | Guth | 134/58 D |
| 3,702,680 | 11/1972 | Woehler | 134/58 D X |

*Primary Examiner*—Robert L. Bleutge
*Attorney, Agent, or Firm*—Hill, Gross, Simpson, Van Santen, Steadman, Chiara & Simpson

[57] ABSTRACT

A dishwasher having a washing chamber with upper and lower dishracks disposed therein and having associated therewith upper and lower spray devices supplied with washing liquid respectively by first and second pumping devices. The first and second pumping devices are commonly mounted in a sump of the washing chamber and driven by a single unidirectional motor. The pumping devices are positioned in axial relation to one another with the lower or first pumping device supplying washing liquid at a lesser pressure to the upper spray device and the upper or second pumping device supplying washing liquid at a higher pressure to the lower spray device. A water level control is provided to supply the washing chamber with first and second levels of washing liquid with the lower pumping device supplying washing liquid to its associated spray device at both the first and second levels of washing liquid and the upper pumping device supplying washing liquid to its associated spray device only when the second level of washing liquid is present in the washing chamber. The lower pumping device supplies washing liquid alternatively to the upper spray device or to a drain conduit.

1 Claim, 5 Drawing Figures

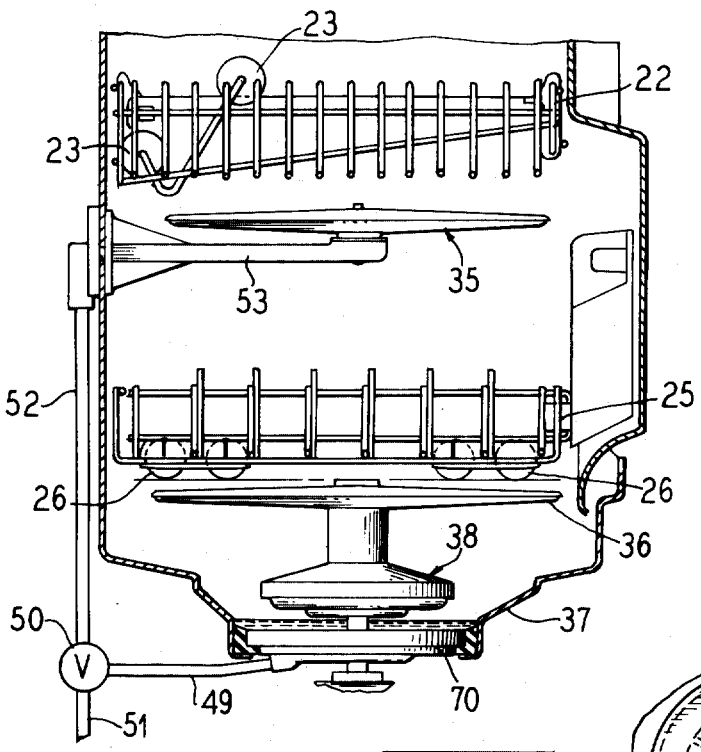
Fig. 3
Fig. 5
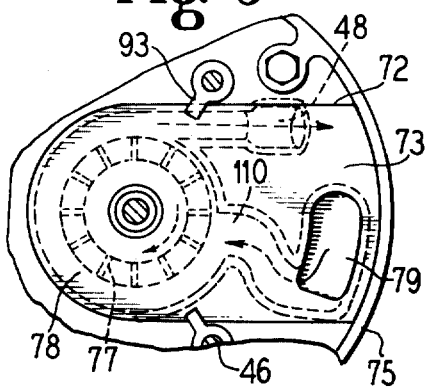
Fig. 4
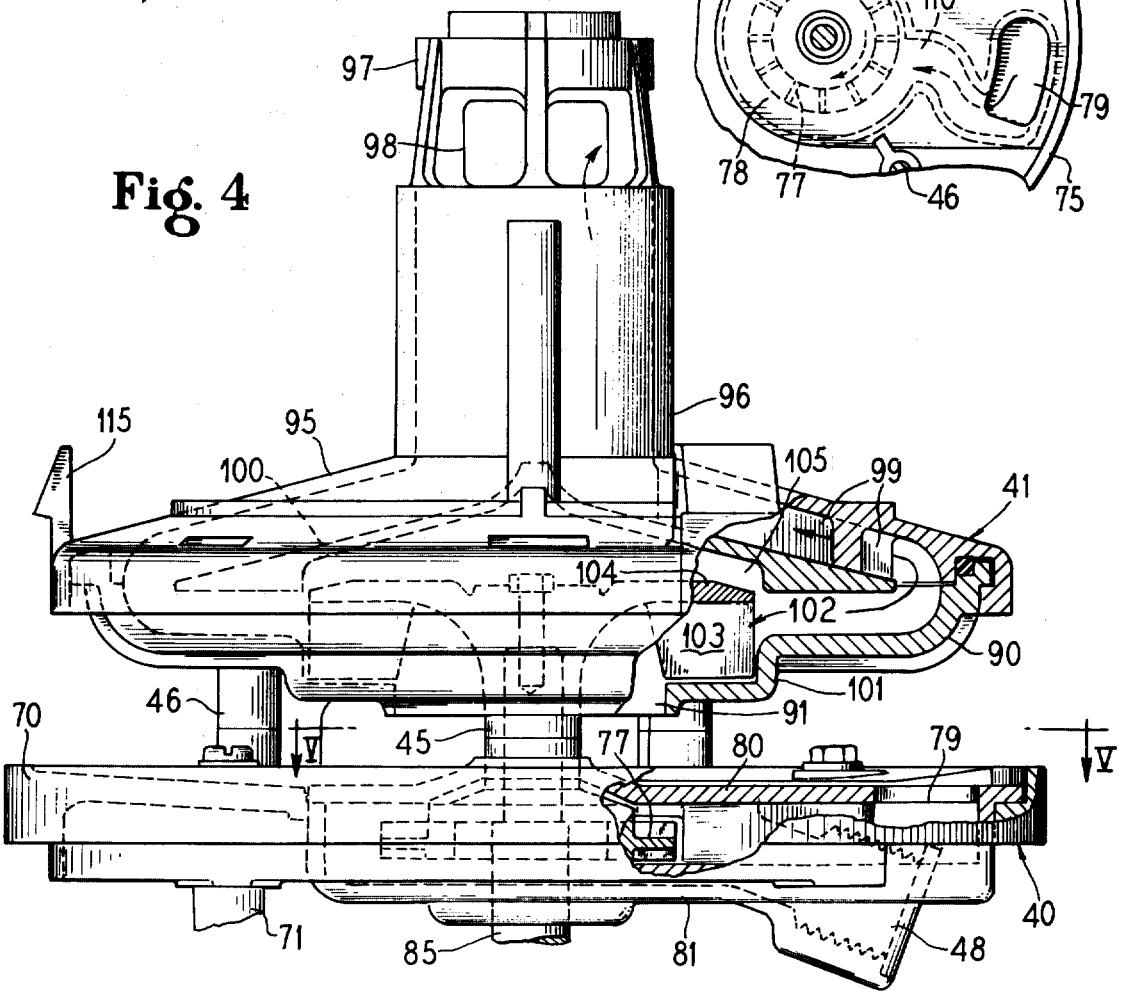

DISHWASHER WITH SPECIAL LOW WASHING LIQUID USAGE CYCLE

BACKGROUND OF THE INVENTION

1. Field of the Invention

This invention relates to appliances and more particularly to a dishwasher having a special low washing liquid usage cycle.

2. Prior Art

Appliances, particularly dishwashers, are often provided with internal spraying devices for directing a stream of washing liquid at objects to be washed. In the case of dishwashers, it is known to provide washing chambers having a bottom sump with a motor driven pump positioned therein effective to supply washing liquid under pressure to a spraying device which directs a stream of washing liquid at dishes held in a rack positioned within the washing chamber. It has also been known to provide dishwashers having two dishracks disposed therein, one above the other, each being associated with a spraying device. The use of two spraying devices interiorly of the washing chamber provides improved washing of the dishes when separate dishracks are used.

It has been known to supply the two spraying devices with washing liquid from a common pump disposed in the sump. It has also been known to supply each of the spraying devices individually from two pumping devices disposed in the sump. Normally where two pumping devices are used, they are commonly driven by a separate motor and it has been known to axially space the pumping devices from one another with the lower pumping device providing washing liquid to the upper spray device and the upper pumping device providing washing liquid to the lower spray device. (See, for example, U.S. Pat. No. 3,179,307 to Duncan et al. and U.S. Pat. No. 3,084,701 to Hardy et al.) By disposing the pumping devices in a sump at the bottom of the washing chamber, it is assured that the pumping devices will be effectively supplied with washing liquid. In addition, this positioning allows the pumping devices to be used to drain the washing chamber, generally by reversal of the direction of rotation of the pumping devices, or, as disclosed in U.S. Pat. No. 2,629,390 to F. G. Walker, by utilizing a two-way valve.

Although such prior devices work effectively when there is a full load in the washing chamber, they are uneconomical when a partial load is being washed. In such instances, since both pumping devices are acting constantly to supply washing liquid to both spraying devices, a wasteful amount of washing liquid is utilized and an unnecessary amount of energy is expended in heating the washing liquid and in delivering the washing liquid to the spraying devices.

It would therefore be an advance in the art to provide a dishwasher having a special cycle delivering washing liquid to only one spray device during operation of the special cycle while being capable of delivering washing liquid to two spray devices during a normal cycle.

It is often desirable, in a dishwasher, to wash relatively fragile items such as, for example glassware, crystal, or the like by exposure to a more gentle spray than would be used to wash more rugged items such as pots and pans; and it has been known in the prior art to selectively provide such a gentle spray. See, for example, U.S. Pat. No. 2,990,835 to D. S. Cushing. It would be an advance in the prior art, however, to provide such a gentle wash action in a dishwasher having at least two dishracks disposed therein with a separate spray device associated with each wherein one of the spray devices provides a gentle spray and may be operated while the other spray device is inoperative when an energy-saving low fill condition is selectively provided.

SUMMARY OF THE INVENTION

Our invention provides an appliance with a special cleaning cycle and more particularly provides a dishwasher having disposed therein upper and lower spray devices supplied with washing liquid from a pumping assembly which is capable of supplying washing liquid either to both spray devices during a normal cycle or to one spray device only during a special cycle. In the latter event, a lesser amount of washing liquid is utilized. Since the washing liquid normally consists of hot water, the ability to use a lesser amount of washing liquid results in a dual energy economy resulting from the use of a lesser amount of heated water and from the expenditure of less energy to supply washing liquid to only one spray device as opposed to supplying washing liquid to two spraying devices.

It will be understood that whenever the term washing liquid is used herein, the term covers not only liquid utilized during the wash cycle which may, for example, consist of hot water to which detergents, wetting agents and the like have been added but also to rinse liquid which normally consists of clear water, either hot or cold to which wetting agents may or may not be added.

Basically, our invention provides a washing chamber having at least two dishracks disposed therein in spaced relation to one another. Two spray devices are received in the washing chamber, one spray device being associated with each dishrack. The spray devices are provided with washing liquid under pressure from a common pump assembly. The pump assembly is received in a sump in the washing chamber and consists of two pump devices commonly mounted and driven by a single unidirectional motor which, in a preferred embodiment, is positioned exteriorly of the washing chamber below the sump portion of the washing chamber. The pump devices each have separate inlets and separate outlets with the inlet of the first or axially lower pump device being positioned below the inlet of the second or axially upper pump device. In this manner, when a first level of washing liquid, constituting a normal fill or full level of washing liquid, is present in the sump, both pumping devices will supply washing liquid to their associated spray device. However, when a second fill level, or lesser level of washing liquid is provided in the sump, only the first pumping device will be provided with washing liquid and therefore only its associated spray device will be supplied with washing liquid.

In this manner, we provide a dishwasher having the capability, by selectively controlling the fill level or washing liquid level interior of the washing chamber, to supply washing liquid under pressure to one or both spray devices.

Thus, when, for example, it is desired to clean only a relatively small number of dishes, only that dishrack associated with the first pumping device associated spray device is loaded. Thereafter, by selecting the special cycle, a low level fill or lesser than normal amount of washing liquid will be provided to the washing chamber resulting in relatively low washing liquid usage during the cycle. In this manner, only the first pumping device will be supplied with washing liquid through its inlet. The first pumping device will supply washing liquid only to its associated spray device.

In a further improvement, the outlet from the first pumping device is to a conduit having a valve associated therewith, the valve being effective to direct the pump output either to the associated spray device or to drain. In this manner, the first pumping device functions as a drain for the washing chamber without the necessity of using dual pump outlets or a reversible motor.

The control system for regulating the amount of washing liquid in the chamber to provide for either the normal or the special cycle can be any of a number of readily available devices including, but not limited to, water supply shut-off switches activated either by level sensing devices within the washing chamber or by timing devices or the like. In addition, secondary control devices can be provided allowing the first pumping device to drain the washing chamber until the desired washing liquid level is obtained.

According to a variation of the embodiment of the invention heretofore described, the first pumping device could be adapted to provide washing liquid to its associated spray device under a lower pressure than that supplied by the second pumping device, or the spray device associated with the first pumping device could itself be adapted to provide a relatively gentle spray. In either case, the result is a gentle washing action applied to items contained in the rack associated with the first spray device and a more vigorous washing action applied to items contained in the rack associated with the second spray device. This embodiment of the invention will provide a glassware cycle for the dishwasher in response to a low level fill which is particularly useful in efficiently washing large numbers of glassware items such as party glasses, crystal, etc. without requiring as much washing liquid or as much energy as would be needed to wash the same items in a conventional dishwasher.

It is therefore an object of this invention to provide a dishwasher having two dishracks disposed within a common washing chamber, each dishrack having a spraying device associated therewith, each of the spraying devices supplied with washing liquid from different pumping devices and control means for providing washing liquid to one spray device only or to both spray devices simultaneously.

It is another and more particular object of this invention to provide a dishwasher with a special cycle supplying washing liquid to only one or to both of two spray devices positioned interiorly of a common washing chamber in dependent response to the amount of washing liquid within the washing chamber.

It is another and more particular object of this invention to provide a dishwasher having a single washing chamber with upper and lower dishracks disposed therein and upper and lower spray devices positioned within the washing chamber effective to supply washing liquid respectively to the upper and lower dishracks, the upper and lower spray devices supplied with washing liquid respectively by lower and upper pumping devices positioned within a sump of the washing chamber and commonly driven by a motor, the upper and lower pumping devices having separate inlets thereto positioned at separate levels within the sump whereby either one or both of the pumping devices will be supplied with washing liquid in dependent response to the washing liquid level in the sump, and control means for controlling the level of washing liquid within the sump.

It is another and more specific object of this invention to provide a dishwasher having a washing chamber with a sump at the bottom thereof, two pumping devices positioned in said sump commonly driven by a single motor, each of said pumping devices supplying washing liquid from the sump under pressure to an associated spray device, the pumping devices having separate inlets positioned at different levels within the sump whereby only one of said pumping devices will be supplied with washing liquid when the amount of washing liquid within the sump is below a given level, means for controlling the level of washing liquid within the sump to allow selective utilization of only one of the spray devices or both of the spray devices simultaneously, and the pumping device with the inlet which is supplied with washing liquid at the lower level of washing liquid within the sump being connected selectively to either its associated spray device or a drain conduit.

It is another and still more specific object of this invention to provide a glassware cycle for a dishwasher having at least two dishracks and at least two spray devices each associated with a different dishrack wherein one of said spray devices provides a gentle wash action and the other of said spray devices is inoperative where a low level fill is provided for the dishwasher.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 3 is a view similar to FIG. 2 on a reduced scale illustrating a special cycle washing liquid level;

FIG. 4 is a fragmentary view partially in section of the pumping assembly of a dishwasher according to the invention; and FIG. 5 is a fragmentary, partially sectional, view taken along the lines V—V of FIG. 4 and showing underlying portions by broken lines.

DESCRIPTION OF A PREFERRED EMBODIMENT

Figure 1:
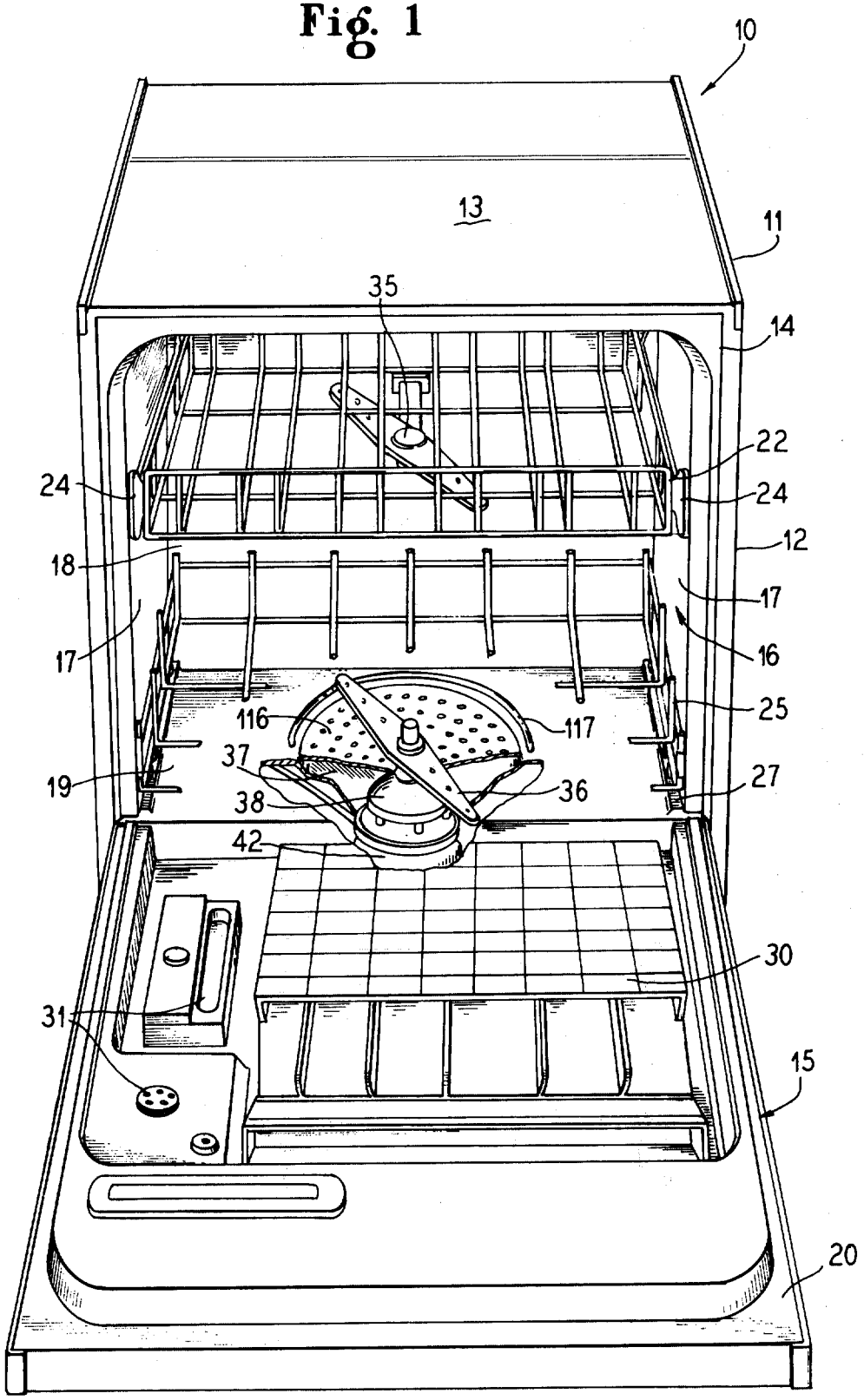
FIG. 1 is a front perspective view of a dishwasher shown in a door-open position with portions broken away to show underlying features.

FIG. 1 illustrates generally an appliance such as a dishwasher 10 equipped with an outer cabinet 11 including sides 12, a top 13 and back and bottom walls (not shown). The front 14 of the cabinet is open and is closable by a door assembly 15. Disposed interiorly of the cabinet 11 is a washing chamber 17 which has side walls 17, a back wall 18, a bottom wall 19 and a top wall (not shown). The front wall of the washing chamber, in the embodiment illustrated, is formed by an inner panel 20 of the door 15. Seal elements may be provided to seal the washing chamber when the door 15 is in a closed position.

Disposed interiorly of the washing chamber is an upper dishrack 22 which is equipped with rollers 23

(see FIG. 2) mounted in roller channels 24 to allow the dishrack 22 to be at least partially withdrawn from the washing chamber. A lower dishrack 25 is positioned in the bottom portion of the washing chamber 16 and is equipped with rollers 26 which, in the embodiment illustrated, may ride on a ledge portion 27 (see FIG. 1) of the side walls 17 and on an aligned track portion of the inner panel 20 of the door 15 when the rack 25 is to be removed from the interior of the washing chamber.

In the embodiment illustrated, the inner wall 20 of the door 15 is equipped with a rack assembly 30, which may receive silverware or the like, and is further equipped with dispensers 31, which for example, may automatically dispense detergents, wetting agents and the like.

It will be appreciated that, although not shown, the dishwasher is equipped with a control panel allowing actuation of the dishwasher and selection of the desired dishwashing cycle. Such a control panel may be positioned on cabinet 11 or on the front of the door 15. In the embodiment illustrated, it will be appreciated that the door is hingedly attached to the cabinet and is openable outwardly and downwardly. Further, the door will, in a preferred embodiment, be equipped with a latch mechanism for maintaining the door in a closed position. It is to be appreciated that the arrangement as shown herein is only for purposes of illustration and the invention hereinafter described is usable with other types of dishwashers including, by way of example, that class of dishwasher which is opened at the top or that class of dishwasher which includes a washing chamber which can be entirely slid out of the front of a cabinet housing.

Positioned interiorly of the washing cabinet is an upper spray device 35 preferably located under the upper dishrack 22. A lower spray device 36 is preferably positioned below the lower dishrack 25. The spray devices 35 and 36 are preferably of the rotating type and are rotated by jet action of the washing liquid exiting the spray device under pressure. The spray devices are supplied with washing liquid from a sump 37 formed in the bottom 19 of the washing chamber centrally thereof. The washing liquid is pumped from the sump to the spray devices by means of a pump assembly 38.

Figure 2:
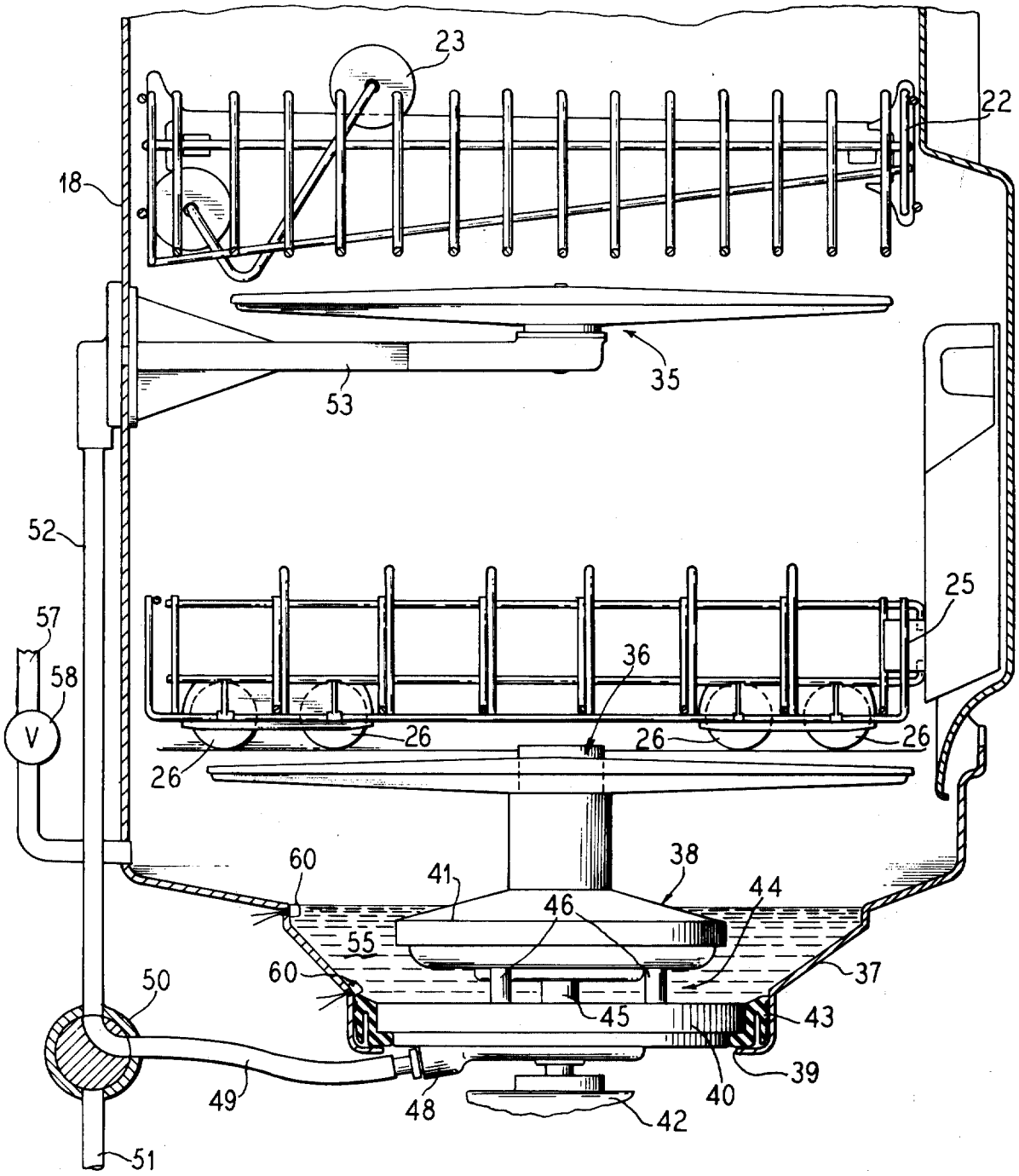
FIG. 2 is a fragmentary cross-sectional view of portions of the dishwasher of FIG. 1 showing a normal washing liquid level.

As best illustrated in FIGS. 2 through 4, the pump assembly 38 is positioned at the bottom 39 of the sump 37 and consists of first 40 and second 41 pumping devices commonly driven by a unidirectional motor 42. The first pumping device 40 is surrounded by a gasket 43 closing the bottom of the sump so that the motor 42 is positioned externally of the washing chamber and will not be affected by the moisture conditions thereof. The first and second pumping devices 40 and 41 are spaced apart from one another with a clearance 44 therebetween. They are attached together by a common drive shaft portion 45. In addition, the second pumping device 41 may be supported on the first pumping device by support posts 46 or the like.

The first or lower pumping device 40 has a discharge outlet 48 therefrom which, in the embodiment illustrated, is below the washing chamber. The discharge outlet 48 is connected in fluid communication to a conduit 49 which in turn is connected to a diverter valve 50 which is capable of selectively coupling the conduit 49 to a drain 51 or to a conduit 52. The conduit 52 is connected through the back wall 18 of the washing chamber to a combination spray device mounting arm and washing liquid conduit assembly 53 which is fixedly attached to the back wall 18 and which has a conduit chamber therein for supplying washing liquid to the upper spray device 35. The outlet from the second or upper pumping device 41 is connected to the lower spray device 36.

Both of the pumping devices have inlets open to the sump such that when the sump is filled to a first level of washing liquid as illustrated in FIG. 2, and as further hereinafter described, they are capable of supplying a continuous flow of washing liquid to their associated spray devices. In the embodiment illustrated, the first or lower pumping device 40 receives washing liquid from the sump and discharges it at a higher pressure through the outlet 48 to the upper spray device 35. The upper or second pumping device 41 receives washing liquid from the sump and discharges it at a higher pressure to the lower spray device 36.

Washing liquid 55 may be provided to the washing chamber for example through an inlet 56 coupled to a conduit 57 via a shutoff valve 58. The conduit 57 is connected to a water source. The amount of washing liquid to be delivered to the washing chamber through the inlet 56 may be controlled in any of a number of ways; for example, the valves 58 can be controlled by selective timers. To insure that a desired amount of water or other washing liquid is supplied to the sump during any preselected time, the valve 58 may be a constant flow valve. Alternatively, the valve 58 may be controlled by liquid level sensors 60.

It is to be appreciated that the dishwasher of this invention can be provided with a large number of different full cycles each of which may call for filling the sump with washing liquid a plurality of times. In addition, the amount of washing liquid supplied each time may be the same or may differ in accordance with the nature of the complete cycle which may require, for example, one or more washing cycles, one or more rinsing cycles, and one or more drying cycles.

In accordance with this invention, for a normal fill when a first level of washing liquid is provided to the sump, both spray devices 35 and 36 will be supplied with washing liquid. For a low level fill, when a second level, as illustrated in FIG. 3, of washing liquid is provided to the sump only one of the spray devices will be supplied with washing liquid. This concept may be utilized within the confines of an overall wash-dry multi-cycle operation in a variety of combinations. Thus, for example, where it is desired to provide an overall wash-dry cycle having only one of the spray devices supplied with washing liquid, the amount of washing liquid introduced to the washing chamber will be limited to the second level which corresponds to a low level fill. Where it is desired to provide two or more washing or rinsing cycles with one of the washing or rinsing cycles utilizing only one of the spray devices, then at various times during the entire wash-dry cycle the washing liquid introduced into the washing chamber will be either at the first or the second level.

Delivery of washing liquid to only one of the spray devices is accomplished by the use of separate inlets to the first and second pumping devices with the inlets being located at different levels of the sump. In the embodiment illustrated, the inlet to the first or lower pumping device is positioned below the inlet to the second or upper pumping device and the lower pumping device supplies washing liquid alternatively to the drain 51 or to the upper spray device 35. However, it is to be understood that this arrangement can be varied, for example, by using the lower pumping device to supply washing liquid to the lower spray device 36 with the upper pumping device supplying the upper spray device or by reversing the positioning of the inlets as, for example, by providing an inlet to the lower pumping device through a tube extending to the upper regions of the sump and a second closable inlet at the bottom of the sump for draining the sump.

In the preferred embodiment illustrated, the lower pumping device includes a disk member 70 positioned at the bottom of the sump and attached to the motor by fastening means 71. The disk 70 has an opening 72 therethrough which receives an insert 73. The insert 73 extends from adjacent the periphery 75 of the disk approximately two-thirds of the way across the disk passing through the center thereof. The insert 73 has disposed therein an impeller 77 centrally positioned in an impeller chamber 78 connected to an inlet 79 open to the top of the insert 73. The impeller chamber 78 is also open to the outlet 48. The insert is closed at the top by a top wall 80 and at the bottom by a wall 81. The top wall 80 has the inlet 79 opening therethrough. The outlet 48 projects from the bottom wall 81. A drive shaft 85 of the motor 42 projects through the insert and is operatively coupled to the impeller 77. The drive shaft has a portion thereof projecting through the top wall 80 which may be splined with or otherwise connected to the aforementioned common drive shaft portion 45 extending to the upper or second pumping device 41.

The second pumping device 41 has an axial inlet to and an axial outlet from a radial impeller. The device 41 includes a bottom cover 90 having a centrally disposed opening 91 therethrough into which the drive shaft 45 projects with considerable clearance. The bottom cover 90 may be mounted to the disk 70 by means of the aforementioned posts 45 which may have partial extensions 93 thereon overlying the insert 73 to maintain it in position in the opening 72.

Attached to the bottom cover 90 is a top cover 95 which has a centrally disposed upwardly projecting boss 96 thereon terminating in a spray device supporting head 97. The boss 96 is hollow and openings 98 extend from the head 97 for supplying washing liquid to the spray device 36 supported for rotation thereon. The top cover 95 has its under surface formed with a plurality of curved vanes 99 to which is attached an inner cover 100 having a diameter less than the diameter of the top cover 95. The inner cover 100 and top cover are centrally peaked and the lower cover 90 has a central depression 101 therein surrounding the inlet 91. In the area 105 formed between the depression 101 and the peak of the inner cover 100, there is disposed a pump impeller 102 having arcuate radial vanes 103 thereon closed at the top by a wall 104.

Washing liquid adjacent the bottom of the sump is acted upon by the first pumping device 40 in the following manner. The liquid enters the inlet 79 and is directed therefrom, as indicated by the arrows in FIG. 5, through a channel 110 to the chamber 78. In the chamber, the washing liquid will be pumped by the impeller 77 and will exit the outlet 48. The second or upper pump device 41 will supply washing liquid to the spray device 36 in the following manner. The opening 91 forms an inlet and washing liquid from the sump will pass from the inlet and be acted upon by the rotating impeller 102 which will discharge the liquid as indicated by the arrows in FIG. 4 to the area between the bottom wall 90 and the outer periphery of the inner cover 100. From there, the water will pass to the vane area 99 between the top cover 95 and the inner cover 100 to eliminate the swirling action created by the impeller 102. Thereafter, washing liquid will pass through the boss 96 and from the outlets 98 to the spray device 36.

It can be seen in the embodiment illustrated that the inlet 79 to the lower pump device 40 is positioned below the inlet 91 to the upper pump device 41. Thus, when the sump is filled during a normal fill to the first level as indicated in FIG. 2 where the top of the washing liquid 55 is above the inlet 91 to the upper pumping device 41, both pumping devices 40 and 41 will supply washing liquid to their associated spray devices. When the washing liquid level in the sump is below the inlet 91 to the second pumping device, as is illustrated in FIG. 3, only the lower pumping device 40 will be supplied with washing liquid. By providing the inlet 79 to the lower pumping device at the bottom of the sump 37, it will be assured that the pumping device 40 can effectively drain the washing chamber when the diverter valve 50 connects the conduit 49 to the drain conduit 51.

In the dishwasher as disclosed herein the pump assembly 38 begins to operate with the first introduction of liquid to the washing chamber of the dishwasher. It should be noted, therefore, that the liquid level shown in FIG. 2 represents a normal fill condition with both spray arms operating and that consequently the total volume of liquid present in the dishwasher during the normal cycle includes the liquid being sprayed onto the dishracks at any given time and the liquid present in the conduits and spray devices as well as the liquid in the sump. Similarly, the liquid shown in the sump of the dishwasher in FIG. 3 does not include the entire quantity of liquid present in the dishwasher after a complete low level fill.

In order to insure that un-emulsified foodstuffs or like particles cannot enter the inlets 79 and 91, the top cover 95 may be equipped with clamp devices 115 for supporting a strainer screen 116 (FIG. 1) closing the top of the sump. A heating coil 117 may also be disposed interiorly of the washing chamber 16 on the bottom wall 19 for heating the wash liquid within the washing chamber of the dishwasher.

It can therefore be seen from the above that our invention provides a dishwasher having a washing chamber equipped with upper and lower dishracks each of which is supplied with a stream of washing liquid from associated upper and lower spray devices. The spray devices are supplied with washing liquid from a sump at the bottom of the washing chamber by means of upper and lower pump devices located in the sump. The lower pump device supplies washing liquid to the upper spray device and has an inlet positioned at the bottom of the sump. The upper pumping device supplies washing liquid to the lower spray device and has an inlet positioned above the bottom of the sump. Control means are provided for introducing washing liquid to the sump for a normal fill at a first level or for a low level fill at a second level. When washing liquid is provided at the first level, the inlets to both the first and second pumping devices will be below the washing liquid level. When washing liquid is provided to the sump at the second level, only the inlet to the first or lower pumping device will be below the washing liquid level. In this manner by the simple method of controlling the level of washing liquid in the sump, our invention provides for actuation of either a single one of the two spray devices or both of the spray devices simultaneously. This allows provision of a special cycle for the dishwasher during which only one spray device will be utilized. This provides for economy of operation in that when using the special cycle a lesser amount of washing liquid is provided to the washing chamber, and since the washing liquid is acted upon by only one pumping device, a lesser amount of pump driving energy is expended. Furthermore, since less washing liquid is used, less energy wil be expended by the heating element 117 in maintaining the washing liquid at the necessary temperature.

In addition, this invention makes it possible to easily provide a dishwasher of the type generally described herein with a special gentle or a special high pressure cycle. For that purpose either of the pump devices such as the pumping impellers 70 and 102 may be constructed to provide a greater or a lesser fluid pressure than the other, or either of the spray devices may be designed to discharge wash liquid in a particular pattern, direction, or quantity so that either a gentle or a vigorous washing action is provided by the spray device in question over the contents of the dishrack associated therewith. Thus, one of the spray devices, when operative, will provide a normal washing action; and the other spray device will provide a special washing action (either gentle or vigorous). The dishwasher can be operated through a special cycle by providing a low level fill to the machine. During this special cycle only the spray device providing the special washing action will be operative and the items to be washed, having been placed in the dishrack associated with this spray device, will be subjected only to the special washing action. Only the quantity of washing liquid needed to wash the contents of the one rack will be used and energy will be saved in avoiding the heating and pumping of unnecessary liquid.

As an example of the advantages to be derived from a utilization of this aspect of the invention, a dishwasher of the type described could be provided with a special glassware cycle. The upper spray device 35 (FIGS. 1, 2 and 3), being supplied wash liquid from the lower pump device 40, may be constructed to provide a gentle wash action over the contents of the dishrack 22 which would be highly desirable for washing glasses, crystal, or other relatively fragile glassware. Thus to wash a large number of such items the dishwasher may be operated through several successive complete cycles for which only the rack 22 is loaded and a low level fill is provided. Thus the glassware items will all be washed by exposure to a gentle washing action which is effective but does not create a substantial risk of damage to the items. At the same time substantial liquid and energy savings are realized through the low level fill and the inoperative condition of the lower spray device 36 inasmuch as only the amount of liquid and the quantity of heat and pumping energy necessary to effectively wash the contents of dishrack 22 are expended.

Although the teachings of our invention have herein been discussed with reference to specific theories and embodiments, it is to be understood that these are by way of illustration only and that others may wish to utilize our invention in different designs or applications.

The embodiments of the invention in which an exclusive property or privilege is claimed are defined as follows:

1. In an automatic dishwasher, wall means forming a washing chamber and comprising a bottom wall configured to provide a depressed sump in the lower portion of said washing chamber, first and second movable dish racks disposed in said washing chamber at successively different levels superjacent said sump, an upper rotary spray arm positioned below the uppermost dish rack and positioned to direct a flow of washing and rinsing liquid from said spray arm upwardly against the dishware carried thereby, a lower rotary spray arm positioned below the lowermost dish rack and positioned to direct a flow of washing and rinsing liquid upwardly against the dishware carried thereby, a pumping assembly comprising first and second pumps disposed in vertically stacked relation in said sump and further including a unidirectional electric motor positioned below said sump and having a power take-off shaft extending upwardly into said sump to form a common unidirectional rotary drive for said first and second pumps, said first pump having a casing in the lowermost portion of said sump and having an outlet passage formed in said casing with an inlet port intersecting an upper wall of said casing and opening into said sump at a first lower level in said sump, said casing having an outlet passage formed with a discharge outlet adapted to be connected to a conduit, said second pump having a radial impeller formed with an axial inlet disposed at a second level in said sump above the level of said first inlet and an axial outlet opening directly coupled with said lower rotary spray arm, said first and second pumps having pumping impellers of different pressure pumping capacity with the pumping impeller of said first pump constructed to discharge under a lesser increased pressure than the pumping impeller of said second pump thereby to provide a gentle reduced pressure washing action at the upper rotary spray arm for dishware in the uppermost dish rack, water level control means for admitting water into the sump and including water sensing means disposed at said first level and at said second level to selectively vary the quantum of washing and rinsing liquid in the sump, conduit means between said discharge outlet of said first pump and said upper rotary spray arm and a drainage outlet, a two-way valve in said conduit means for selectively connecting said first pump to said upper rotary spray arm and said drainage outlet to drain, and sequence control means for automatically programming said dishwasher through a preselected series of washing and rinsing steps including a special glassware cycle wherein liquid level is limited to said first lower level and liquid at reduced pressure will be gently sprayed in said washing chamber only by said upper spray arm, the second pump being rendered inoperative by virtue of its associated inlet being disposed above the level of the liquid in the sump.

* * * * *